US007021436B2

(12) United States Patent
Hoberman et al.

(10) Patent No.: US 7,021,436 B2
(45) Date of Patent: Apr. 4, 2006

(54) ADJUSTABLE FOOT FOR LUGGAGE CASE WITH WHEELS

(75) Inventors: Barry Hoberman, Coral Springs, FL (US); Long Hoang, Pompano Beach, FL (US)

(73) Assignee: Travelpro International, Inc., Boca Raton, FL (US)

( * ) Notice: Subject to any disclaimer, the term of this patent is extended or adjusted under 35 U.S.C. 154(b) by 0 days.

(21) Appl. No.: 10/744,780

(22) Filed: Dec. 23, 2003

(65) Prior Publication Data

US 2005/0133326 A1 Jun. 23, 2005

(51) Int. Cl.
*A45C 5/14* (2006.01)
*A45C 13/00* (2006.01)

(52) U.S. Cl. ..... 190/18 R; 190/18 A; 280/37; 280/47.29

(58) Field of Classification Search ..... 190/18 R, 190/18 A; 280/37, 47, 29
See application file for complete search history.

(56) References Cited

U.S. PATENT DOCUMENTS 940,421 A * 11/1909 Bain ..... 190/18 R
995,942 A * 6/1911 Bain ..... 190/18 R
1,081,670 A * 12/1913 James ..... 190/18 A
4,538,709 A 9/1985 Williams et al.
4,575,109 A 3/1986 Cowdery
4,618,035 A * 10/1986 Mao ..... 190/18 A
5,044,476 A 9/1991 Seynhaeve
5,323,886 A * 6/1994 Chen ..... 190/18 A
5,374,073 A * 12/1994 Hung-Hsin ..... 280/30
5,469,944 A 11/1995 Wang
5,524,920 A 6/1996 Tsai
5,758,752 A 6/1998 King et al.
5,797,617 A * 8/1998 Lin ..... 280/655
5,873,145 A 2/1999 Chou
6,082,510 A 7/2000 Liang
6,182,981 B1 2/2001 Kuo
6,227,339 B1 * 5/2001 Bogert ..... 190/18 R
6,345,414 B1 2/2002 Chen
6,382,375 B1 * 5/2002 Chang ..... 190/18 R
6,405,842 B1 6/2002 Tsai
6,446,987 B1 9/2002 Abraham et al.
6,478,315 B1 11/2002 Manesis
6,497,311 B1 12/2002 Tiramani et al.
6,533,086 B1 3/2003 Waddell et al.
6,575,493 B1 * 6/2003 Lowenstein ..... 280/655.1
2002/0162717 A1 * 11/2002 Lin et al.
2003/0042090 A1 * 3/2003 Wang
2003/0066724 A1 * 4/2003 Chen
2004/0069583 A1 * 4/2004 Tamura
2004/0144606 A1 * 7/2004 Han ..... 190/18 A

* cited by examiner

*Primary Examiner*—Sue A. Weaver
(74) *Attorney, Agent, or Firm*—Sacco & Associates, PA

(57) ABSTRACT

The invention is directed to an article of upright rolling luggage including a luggage case having a bottom wall, a top wall opposed from the bottom wall, and a rear wall extending between a rear edge of the bottom wall and a rear edge of the top wall. The invention also includes one or more wheels rotatably mounted to a portion of the luggage case substantially at the rear edge of the bottom wall. One or more bases extend from the bottom wall and having at least one portion spaced apart from the wheel. One or more feet are movably mounted to the base where the foot is movable from a first position substantially adjacent to the bottom wall to a second position extending away from the bottom wall.

25 Claims, 6 Drawing Sheets

ADJUSTABLE FOOT FOR LUGGAGE CASE WITH WHEELS

FIELD OF THE INVENTION

The present invention relates to luggage, and more particularly, movable structures for stabilizing luggage with wheels.

BACKGROUND OF THE INVENTION

Luggage cases have been combined with wheels at the bottom of the case to allow for easy transportation. Without the wheels, users had to carry their luggage in their hand or on their back; however, combining wheels with a luggage case allows a user to simply roll the luggage from place to place. The combined luggage and wheel design greatly eased the burden of carrying luggage, particularly for people with less strength and/or a physical limitation.

While the combination of wheels and luggage cases have greatly lessened the burden of travel, such combination has also led to an increasing phenomenon. Luggage cases have become increasingly more voluminous and capable of storing larger, and therefore, heavier loads. Although most users do not have any problems rolling a heavier and/or more voluminous luggage case from place to place, some users have experienced problems in attempting to stabilize a luggage case in an upright position.

Some upright rolling luggage cases include an expandable compartment that is located on the face of the luggage opposite from the wheels. When such a compartment is filled with objects, the center of gravity of the luggage case shifts, increasing the tendency for the case to fall over from it's upright position. Although many luggage cases have an expandable compartment, most such luggage cases do not have a structure to help support the additional off center weight.

Some luggage case designs have attempted to provide a solution to luggage cases with the tendency to fall from an upright position. U.S. Pat. No. 5,469,944 to Wang is directed to a swivel foot for travel bags in order to prevent the bags tipping forward. U.S. Pat. No. 6,405,842 to Tsai is directed to an activation of a support member that moves forwardly to prevent forward tipping. U.S. Pat. No. 5,044,476 to Seynhaeve is directed to front support wheels that can be moved to support the bag. U.S. Pat. No. 4,575,109 to Cowdery is directed to internally housed support legs. U.S. Pat. No. 5,758,752 to King et al. is directed to rear wheels that swivel to change the center of gravity.

Nevertheless, the luggage case designs discussed above are prone to damage because the support structures project beyond the edge of the case. Further, many such designs are prone to breakage because of the arrangement and/or structure selected. Thus, there is a need for a support structure for articles of upright rolling luggage cases that is easy to use, prevents inadvertent toppling, and is not prone to damage.

SUMMARY

The present invention is directed to an article of upright rolling luggage including a luggage case having a bottom wall, a top wall opposed from the bottom wall, and a rear wall extending between a rear edge of the bottom wall and a rear edge of the top wall. The article of upright rolling luggage also includes one or more wheels rotatably mounted to a portion of the luggage case substantially at the rear edge of the bottom wall. Further included is one or more base members extending from the bottom wall and having one or more portions spaced apart from the wheel. One or more feet can be movably mounted to the base such that the feet are movable from a first position substantially adjacent to the bottom wall to a second position extending away from the bottom wall. The upright rolling luggage can also include an extensible luggage handle mounted adjacent to the rear wall of the luggage case.

According to one aspect of the invention, the base members can include an elongated body extending between opposing end portions and a foot can be pivotally attached to each of the opposing end portions. Additionally, the elongated body can extend in a direction generally parallel to the rear edge of the bottom wall where the feet are pivotally attached to the opposing end portions. Further, the one or more feet can extend a first distance from the bottom wall when moved to the second position and the one or more wheels can extend a second distance from the bottom wall where the first distance is greater than the second distance.

In one embodiment, an article of upright rolling luggage includes a luggage case having a bottom wall, a top wall opposed from the bottom wall, and a rear wall extending between a rear edge of the bottom wall and a rear edge of the top wall. The upright rolling luggage also includes one or more wheels rotatably mounted to a portion of the luggage case substantially at the rear edge of the bottom wall and one or more base members extending from the bottom wall at a location spaced apart from the one or more wheels. In such an embodiment, the base member(s) can include a ground engaging surface opposed from the bottom wall. The upright rolling luggage further includes one or more feet movably mounted to the base member. Each foot can be movable from a first position, where the foot is between the bottom wall and the ground engaging surface, to a second position where at least a portion of the foot extends in a direction away from the bottom wall and beyond the ground engaging surface.

In one arrangement, the article of upright rolling luggage can include an extensible luggage handle mounted adjacent to the rear wall of the luggage case. The base member can include an elongated body extending between opposing end portions. One foot can be attached to each of the opposing end portions.

In another embodiment, an article of upright rolling luggage includes a luggage case having a bottom wall, a top wall opposed from the bottom wall, and a rear wall extending between a rear edge of the bottom wall and a rear edge of the top wall. The article of upright rolling luggage also includes one or more wheels rotatably mounted to a portion of the luggage case substantially at the rear edge of the bottom wall. Further included is one or more base members extending away from the bottom wall and having one or more portions spaced apart from the one or more wheels. The base member(s) can includes an elongated body and a ground engaging surface opposed from the bottom wall. The article of upright rolling luggage also includes one or more feet movably mounted to the base. Each foot can be movable from a first position where the foot is between the bottom wall and the ground engaging surface, to a second position where at least a portion of the foot extends away from the bottom wall and beyond the ground engaging surface.

In still another embodiment, an article of upright rolling luggage includes a luggage case having a bottom wall, a top wall opposed from the bottom wall, and a rear wall extending between a rear edge of the bottom wall and a rear edge of the top wall. The article of upright rolling luggage can further include one or more wheels rotatably mounted to a portion of the luggage case substantially at the rear edge of the bottom wall. Also included is one or more base member (s) extending from the bottom wall at a location spaced apart from the wheel and one or more feet pivotally mounted to the base. The feet can be movable from a first position substantially adjacent to the bottom wall to a second position extending away from the bottom wall.

BRIEF DESCRIPTION OF THE DRAWINGS

There are presently shown in the drawings embodiments which are presently preferred, it being understood, however, that the invention is not limited to the precise arrangements and instrumentalities shown.

DETAILED DESCRIPTION OF THE PREFERRED EMBODIMENTS

The present invention includes an article of upright rolling luggage that provides a solution to rolling luggage that has a tendency to topple. More particularly, the invention provides additional support for articles of rolling luggage with expandable front loading compartments that can shift the luggage's center of gravity, resulting in the increased tendency to topple. Nevertheless, is should be noted that the invention is not limited to rolling luggage with front loading compartments and can be used with any type, design, and configuration of rolling luggage.

Figure 1:
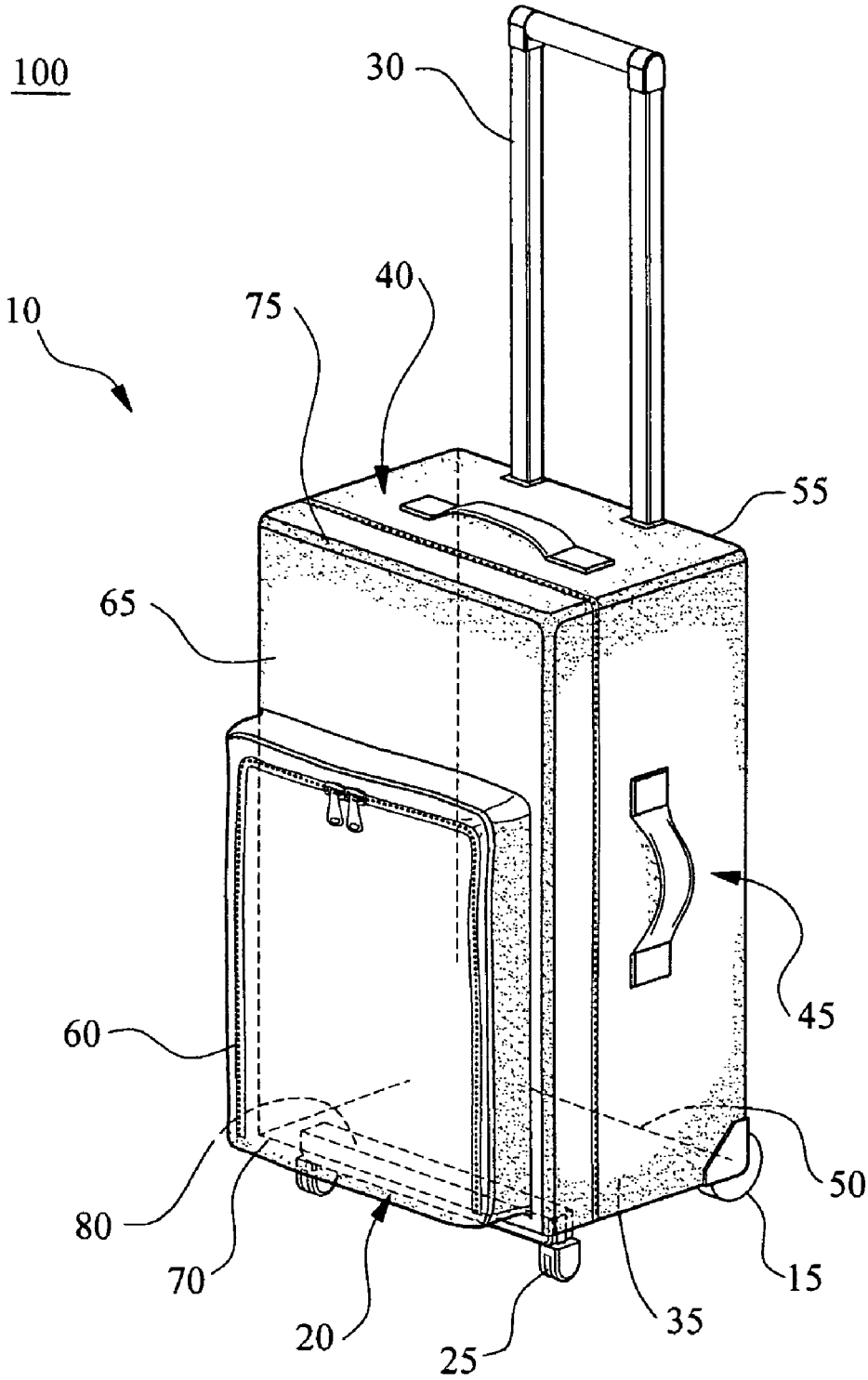
FIG. 1 is a perspective view of a first embodiment of an article of upright rolling luggage that is useful for understanding the inventive arrangements.

FIG. 1 shows an article of upright rolling luggage in one arrangement appropriate for use when extra support is needed. The article of rolling luggage 100 includes a luggage case 10, one or more rotatably mounted wheels 15, one or more bases 20, and one or more feet 25 pivotally mounted to the base 20. The article of rolling luggage 100 can also include an extensible luggage handle 30 and expandable front compartment 60.

The case 10 includes a bottom wall 35 and a top wall 40 opposed from the bottom wall 35. The bottom wall 35 and the top wall 40 can be generally parallel with each other as is known with most rectangular shaped luggage; however, the invention is not limited in this regard as either the bottom wall 35 or the top wall 40 can include curved portions that would not be considered parallel with each other. As used herein, the phrase generally parallel includes true parallel and slight deviations therefrom.

The case 10 further includes a rear wall 45 that extends between a rear edge 50 of the bottom wall 35 and a rear edge 55 of the top wall 40. The case 10 can also include a front wall 65 that extends between a front edge 70 of the bottom wall 35 and a front edge 75 of the top wall 40. Similar to the bottom wall 35 and the top wall 40, the front wall 65 and the rear wall 45 can be generally parallel with each other; however, such a configuration is not necessary. The luggage case 10 can be constructed of any suitable material, such as a cloth material, a webbed material, leather, hard plastic, and even metal. Further, it should be noted that the luggage case 10 can be constructed of multiple materials in combination, such as luggage case 10 with walls of cloth and edges of hard plastic.

The one or more wheels 15 can be rotatably mounted to a portion of the luggage case 10 substantially at the rear edge 50 of the bottom wall 35. Thus, the scope of invention includes variations having the wheels 15 rotatably mounted to the bottom wall 35, rotatably mounted to the rear wall 45, rotatably mounted in the general region defined by the junction of the rear wall 45 and the bottom wall 35, and rotatably mounted to the rear edge 50. The wheels 15 can be rotatably mounted with any suitable structure, such as on an axel coupled to the case 10. Additionally, the wheels 15 can be constructed of any suitable material such as hard plastic, rubber, and the like.

As shown in FIG. 1, the wheels 15 can extend some distance beyond the bottom wall 35 so that the luggage case 10 can be rolled on the wheels 15. The distance beyond the bottom wall 35 which the wheels 15 extend can vary according to the point of coupling and/or the radius length of the wheel 15; however, the invention is not limited to any particular distance as any distance beyond the bottom wall 35 is suitable. It should be noted that providing a wheel 15 having a radius that extends a relatively large distance beyond the bottom wall 35 can ease the burden of rolling the luggage case 10 over uneven terrain.

The luggage case 10 can also include an expandable front compartment 60 that can be coupled to and/or included with the front wall 65. As is known in the arts, the front compartment 60 can be used for storing additional objects and can be extended outward from the front wall 65. When the front compartment 60 is loaded with objects, particularly heavy objects, the center of gravity of the luggage case 10 can shift towards the front compartment 60. Consequently, the shift in the center of gravity can result in inadvertent and unwanted toppling of the luggage case 10.

To add extra support to the luggage case 10 and prevent the luggage falling from an upright position, the luggage case 10 includes one or more bases 20 extending from the bottom wall 35 and having one or more portions spaced apart from the wheel 15. As shown FIG. 1, the base 20 can be located on the bottom wall 35 proximate to the front edge 70 and can extend outward from the bottom wall 35 in a downward direction. Furthermore, the base 20 can have an elongated body 80 and can be orientated so that the elongated body 80 extends in a direction generally parallel to the rear edge 50. Nevertheless, the invention is not limited in either location of the base 20 and the orientation of the base 20. For example, the base 20 can be located along any portion of the bottom wall 35 where one or more portions of the base 20 are spaced from wheel 15. Additionally, the base 20 can be orientated so that the elongated body 80 extends in a direction that is at an angle with the rear edge 50 and in a direction that is generally perpendicular to the rear edge 50.

Figure 2:
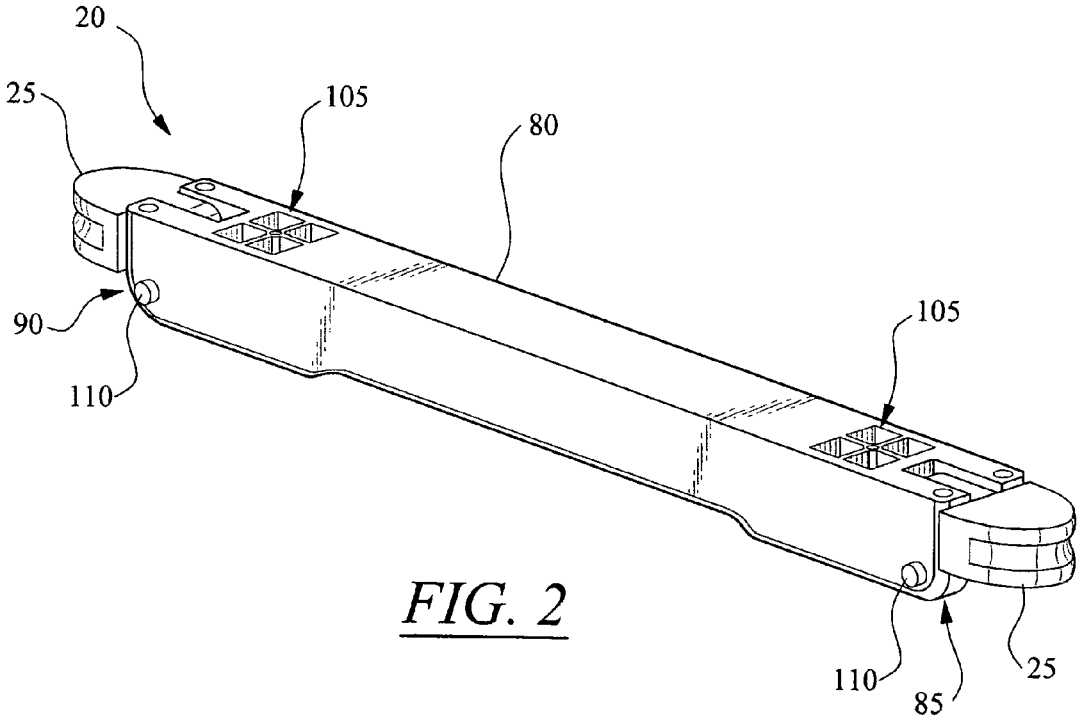
FIG. 2 is a perspective view of one embodiment of a base for an article of upright rolling luggage that is useful for understanding the inventive arrangements.

FIG. 2 illustrates one embodiment of the base 20. The base 20 is shown having the elongated body 80 extending between opposing end portions 85 and 90. The base 20 can include recesses 105 for receiving mounting structures, such as screws, for mounting the base 20 to the bottom wall 35 of the luggage case 10. Although the base 20 is shown as being generally rectangular, the invention contemplates a variety of other configurations, including shapes with curves such as a crescent shape. Additionally, the base 20 can be constructed of any suitable material such as a hard plastic, rubber, metal, and the like.

The base 20 can have one or more feet 25 movably mounted to the base 20. In one arrangement, the feet 25 can be pivotally mounted to base 20 via pivot axel 110. Nevertheless, the invention is not limited in this regard as any movable coupling arrangement can be used. For instance, the feet 25 can be mounted to the base 20 with a hinge or with a ball joint. In another example, a foot 25 can be extensibly mounted to the base 20 and housed within a recess of the base 20 so that the foot 25 moves from a retracted position that is substantially adjacent to the base 20 to an extended position that positions the foot extended away from the bottom wall 35. For such an arrangement, any extensible structure can be used, including a telescoping arm that can extend and retract the foot 25.

As shown in FIG. 2, the feet 25 can be movably coupled to the opposing end portions 85 and 90. Nevertheless, the invention is not limited to an arrangement where the feet 25 are attached to both end portions 85 and 90. In one embodiment (not shown), the elongated body 80 of base 20 can be orientated generally perpendicular with bottom edge 50 and only one foot 25 can be movably coupled to an opposing end 85 that is adjacent to the front wall 65 and opposite to the rear wall 45. While such an arrangement will adequately support the article of rolling luggage 100, one skilled in the art would appreciate the balancing affect provided by adding more than one base 20 orientated generally perpendicular with the bottom edge 50 and having a foot movably attached to an opposing end 85. Still further, the invention is not limited to the feet being attached to the end portions 85 and 90, as the feet 25 can be movably mounted anywhere along the elongated body 20.

Figure 3A:
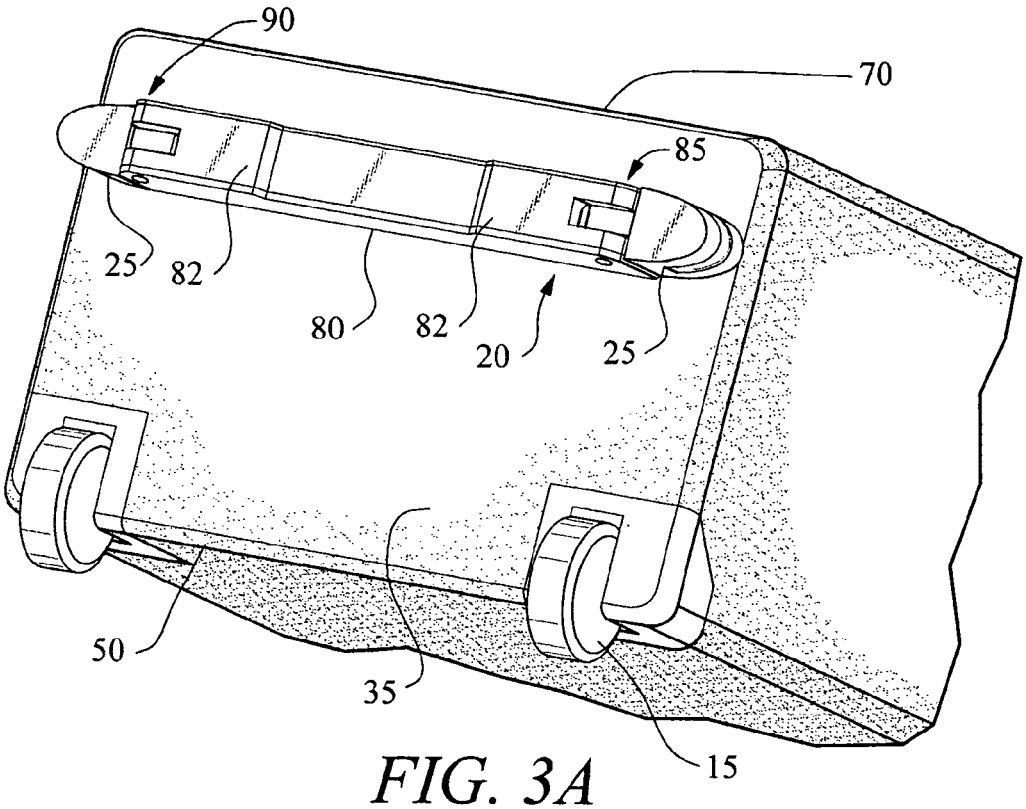
FIG. 3A is a perspective view of the bottom of the upright rolling luggage of FIG. 1 with the feet in a first position.
Figure 3B:
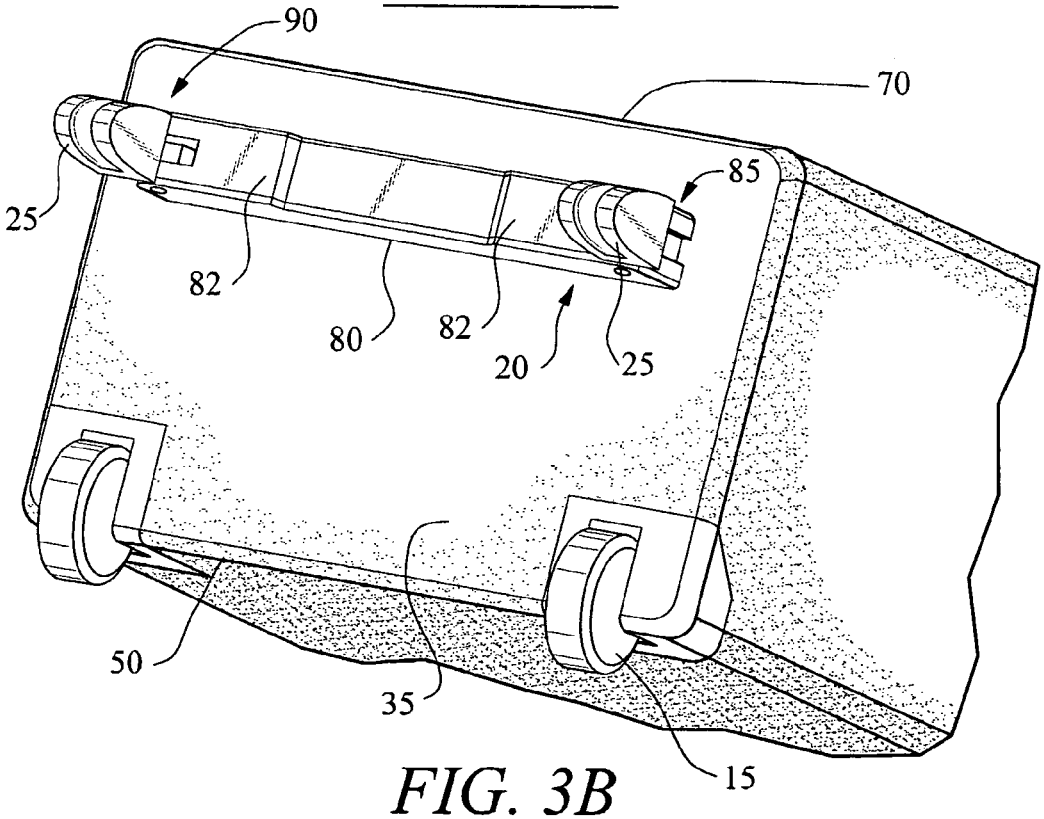
FIG. 3B is a perspective view of the bottom of the upright rolling luggage of FIG. 1 with the feet in a second position.
Figure 3C:
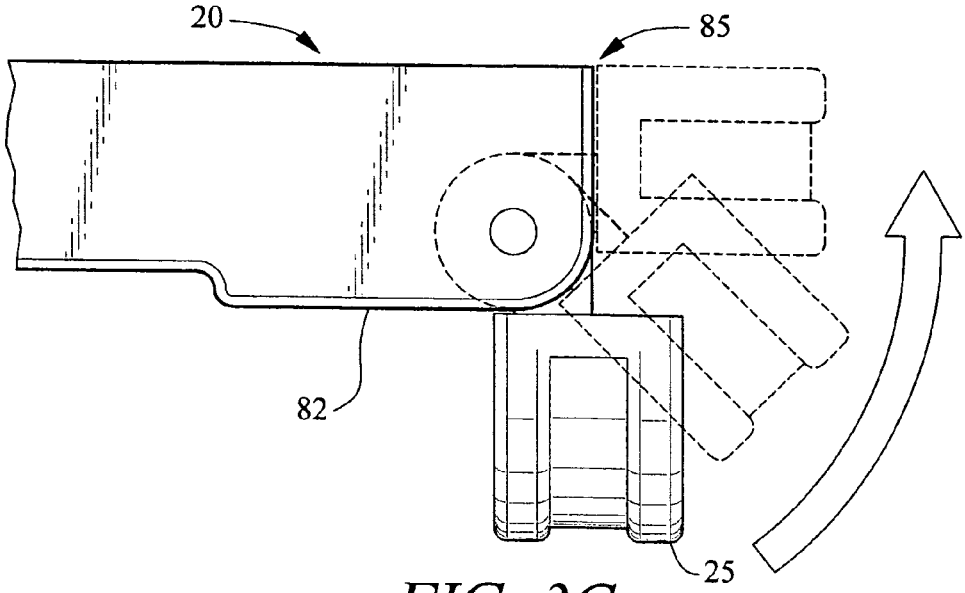
FIG. 3C is a side view of the base in FIG. 2 that is useful for understanding how a foot can be moved from a first position to a second position.

As shown in FIGS. 3A–3C, a foot 25 is movable from a first position substantially adjacent to the bottom wall 35 (shown in FIG. 3A) to a second position extending away from the bottom wall 35 (shown in FIG. 3B). The first position can orientate the foot 25 to laterally extend from the end portion 85 and the second position can orientate the foot 25 to extend in a downward direction away from the bottom wall 35. The motion of moving the foot 25 from the first position to the second position is illustrated in phantom and with an arrow in FIG. 3C. Nevertheless, the range of motion of the foot 25 is not limited as the base 20 can include a recess into which the foot can be rotated for storage and allowing for a greater range of motion. Further, it should be noted that the base 20 and/or the foot 25 can include any suitable mechanism for locking the foot 25 in one or more positions, particularly including the first position and the second position.

The base 20 can also include a ground engaging surface 82 that is opposed from the bottom wall 35. As the ground engaging surface 82 extends outwardly from the bottom wall 35, the ground engaging surface 82 can prevent the bottom wall 35 from engaging the ground. Thus, the ground engaging surface 82 can protect the bottom wall 35 from damage such as tears and/or scratches. The ground engaging surface 82 can include a durable material, such as a hard plastic or rubber, that is able to withstand wear and tear associated with dragging the ground engaging surface 82 along the ground.

Referring FIGS. 3A and 3C, the foot 25 can be positioned in a first position where the foot 25 is between the bottom wall 35 and the ground engaging surface 82. In this first position, the foot 25 does not extend outward beyond the ground engaging surface 82. Thus, the ground engaging surface 82 will generally be the portion, other than wheels 15, of the article of upright rolling luggage 100 that contacts the ground when rested in an upright orientation.

Figure 4A:
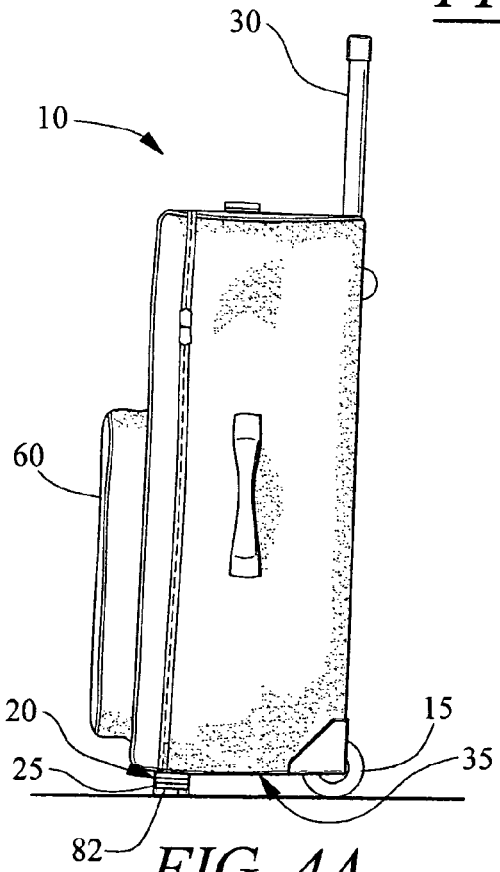
FIG. 4A is a side view of the article of upright rolling luggage of FIG. 1 with feet in a first position.

Such an arrangement is illustrated in FIG. 4A which depicts a side view of luggage case 10 standing level in the upright position resting on the wheels 15 and the ground engaging surface 82 of base 20. This arrangement may adequately support the article of luggage 100 when the center of gravity is not too far toward the front the luggage case 10. In these circumstances, the feet 25 can be conveniently stored in the first position where they do not extend beyond the edge of the case, and therefore, are positioned to limit interference and damage. Nevertheless, the feet 25 are readily available when additional support is needed.

Referring to FIGS. 3B and 3C, the foot 25 can be moved to a second position where the one or more portions of the foot 25 extends away from the bottom wall 35 and beyond the engaging surface 82. In this second position, the foot 25 will be the portion of the article of upright rolling luggage 100 to engage the ground, instead of the engaging surface 82, when rested in an upright orientation. By extending beyond the ground engaging surface 82 and away from the bottom wall 35, the foot 25 can extend a distance from the bottom wall 35 which is approximately equal to or greater than the distance that the wheel 15 extends from the bottom of the wall 35. Nevertheless, the invention is not limited in this regard. For instance, the engaging surface 82 can extend away from the bottom wall 35 the same distance at which the wheel 15 extends from the bottom wall 35. Thus, when the foot 25 is moved to the second position, at least portion of the foot 25 will extend beyond the ground engaging surface 82 and away from the bottom wall 35 a greater distance than the distance that the wheel 15 extends from the bottom of the wall 35.

Figure 4B:
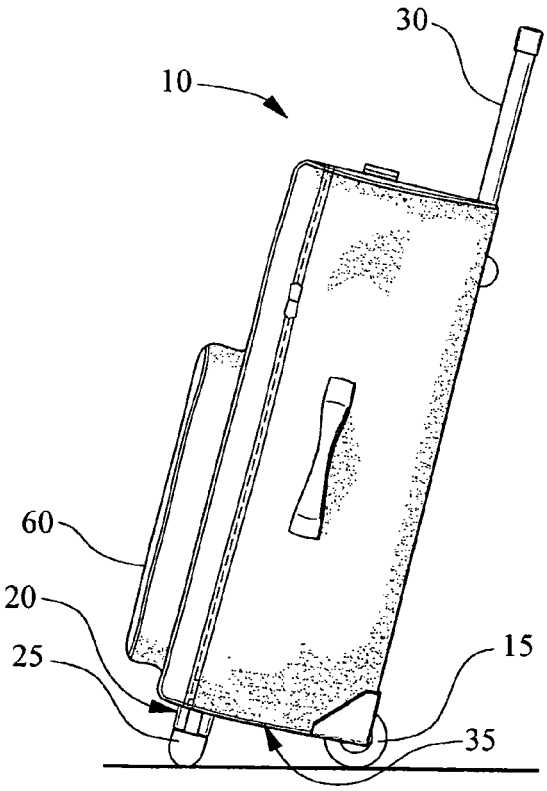
FIG. 4B is a side view of the article of upright rolling luggage of FIG. 1 with feet in a second position.

Such an arrangement is illustrated in FIG. 4B which depicts a side view of luggage case 10 standing in the upright position at an angle with the ground and resting on feet 25 and wheels 15. The feet 25 are in the second position extending a distance from the bottom wall 35 which is relatively greater than the distance which the wheels 15 extend from the bottom wall 35. Nevertheless, the invention is not limited to any particular distance that the feet 25 or the wheels 15 extend from the bottom wall 35 as the distances are relative to each other. It should be readily understood that the feet 25 can extend a first distance from the bottom wall 35 when moved to the second position and that the wheels 15 can extend a second distance from the bottom wall 35. In this embodiment, the first distance is greater than the second distance. Such a difference in distance can cause the article of rolling luggage 100 to stand at an angle with the ground when in the upright position, as shown in FIG. 1.

Such an arrangement is useful when the front compartment has been loaded, and consequently, the luggage case 10 center of gravity has shifted. Extending the feet 25 to the second position causes the luggage case 10 to lean and effectively supports the shifted center of gravity. Without the feet 25 in the second position, the shifted center of gravity may cause the luggage case 10 to fall from its upright position.

The luggage case 10 can also include an extensible luggage handle 30 mounted adjacent to the rear wall 45. The extensible luggage handle 30 can include elongated telescoping support members with a handle. Nevertheless, it should be noted that the invention is not limited in this regard as any suitable extensible luggage handle 30 that is known within the arts can be used. Additionally, the extensible luggage handle 30 can be constructed of any suitable material such as metal, plastic, or hard rubber.

Figure 5:
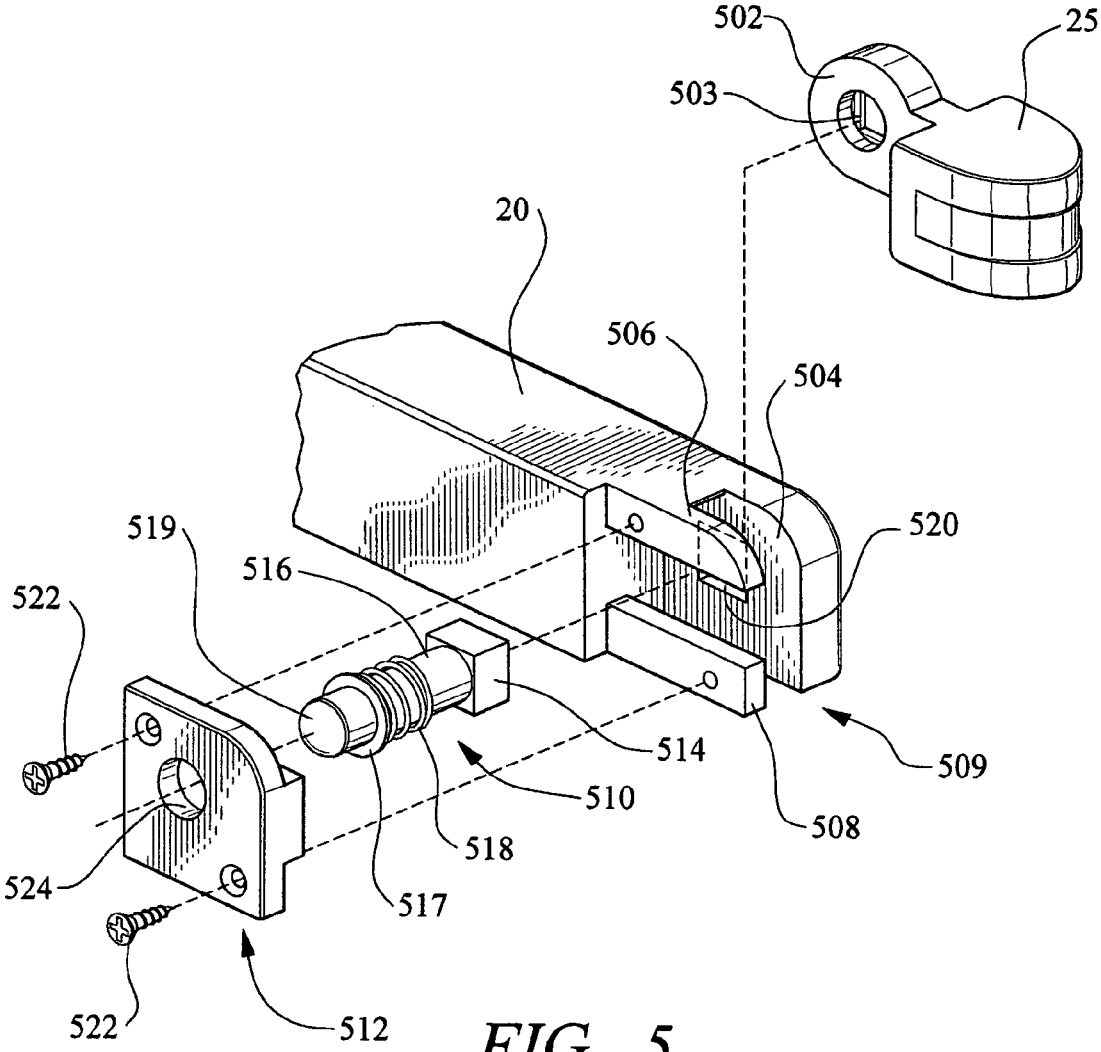
FIG. 5 is a perspective view of a portion of a luggage base that is useful for illustrating a mechanism for locking a foot in a plurality of positions.

The foot 25 can be designed to simply rotate on an axel from a retracted position as shown in FIG. 3A to an extended position as shown in FIG. 3B. However, it can be desirable to provide a mechanism for locking the foot 25 in each position. Two alternative such locking mechanisms are illustrated respectively in FIG. 5 and FIG. 6. Referring now to FIG. 5, there is illustrated a portion of the base 20 showing a mechanism for permitting a foot 25 to be rotated between two different locked positions. A frame 509 can be provided for supporting a disc 502 of the foot 25. The frame 509 can include a shoulder 504 and one or more fingers 506, 508. The disc 502 can be supported on an axel 510 so that it is rotatably seated between the fingers 506, 508 and the shoulder 504. A spring 518 can be disposed on axel 510 and positioned to engage a seat 517. The spring 518 biases the axel 510 away from shoulder 504 to cause a key 514 defined on a distal end of the axel 516 to lockingly engage a profiled bore 503 defined in the disc 502. The axel 516 is prevented from rotating when biased in this way because the key 514 also rests within a profiled seat 520 defined in the shoulder 504.

When a button 519 of axel 510 is depressed, the foot 25 can be unlocked. Depressing button 519 disengages the key 514 from a profiled bore 503 defined within the disc 502. In this unlocked configuration, the disc 502 can rotate freely about a shaft 516 because the key 514 is offset from the profiled bore. However, when the button 519 is released, the key 514 re-engages with the profiled bore 503 and the disc 502 is once again prevented from rotating because the key is engaged with profiled seat 520. Accordingly, the foot is locked and cannot be rotated. A cover plate 512 can be provided with a bore 524 for receiving the button 519 of the axel 516. The cover plate 512 can be secured to the fingers 506, 508 using screws 522. Alternatively, the cover plate can be secured to the fingers using electric welding, a suitable adhesive or any other fastener as would be known to one of ordinary skill in the art.

Figure 6A:
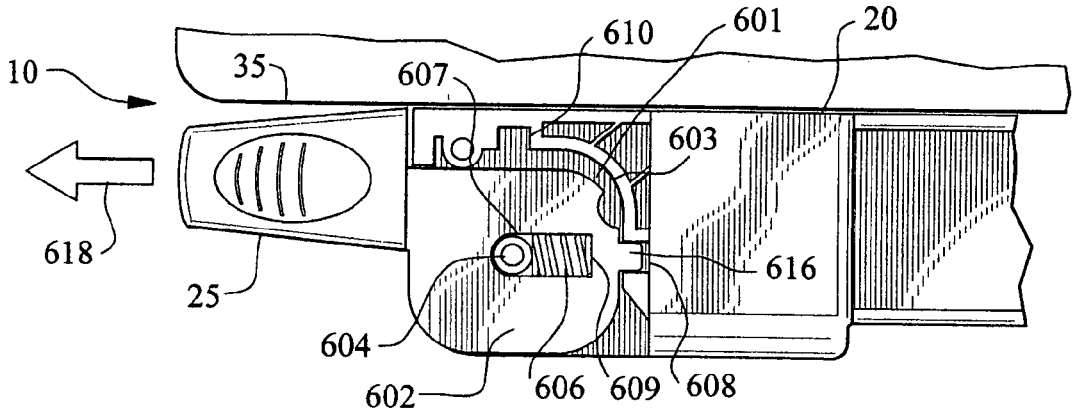
FIGS. 6A–6C are a series of top views of a portion of a luggage base that are useful for illustrating an alternative mechanism for locking a foot in a plurality of positions.
Figure 6B:
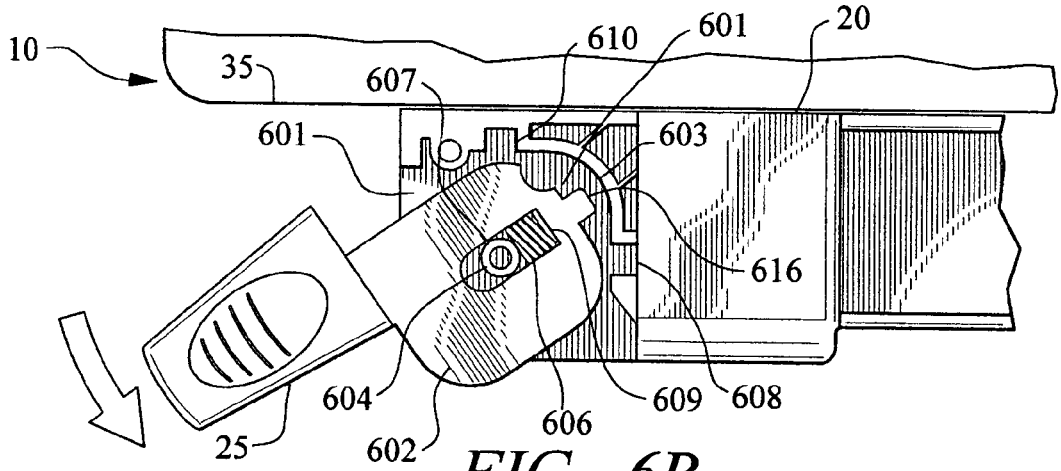
Figure 6C:
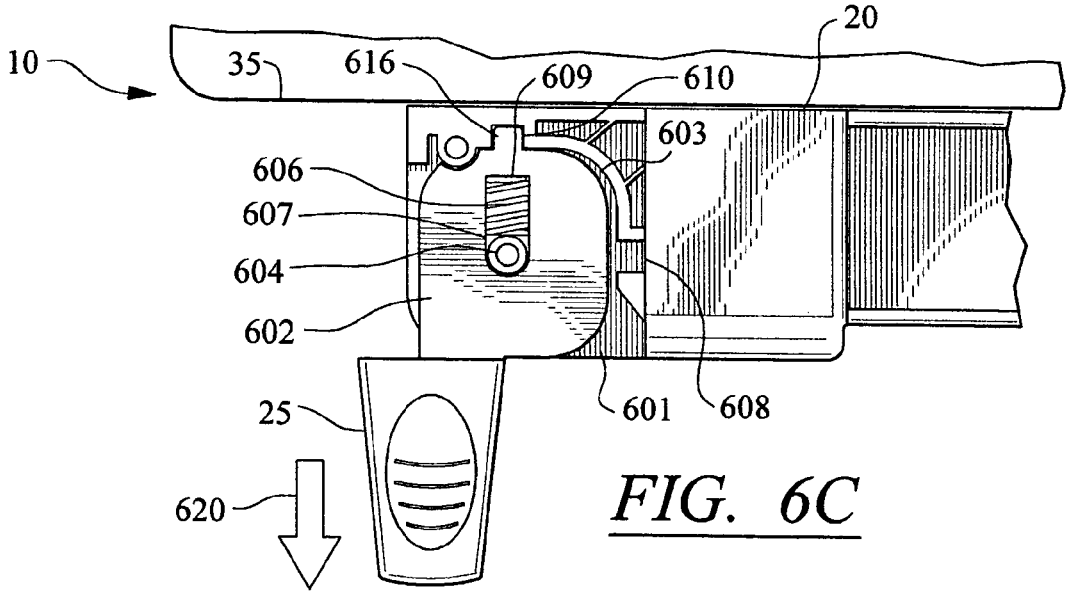

Referring now to FIGS. 6A–6C, there is provided a series of drawings showing an alternative mechanism for permitting a foot 25 to be rotated between two different locked positions. In FIGS. 6A–6C, a base 20 is shown disposed on the bottom wall 35 of luggage case 10. A cover plate (not shown) is removed from the base 20 to more clearly illustrate the operation of the foot locking mechanism.

As shown in FIG. 6A–6C, the foot 25 can include a disc 602 disposed within a recess 601 in the base 20. The recess can include a first locking structure that is sized and shaped for engaging a second locking structure defined on said disc. For example, the disc 602 can include a nub 616 for engaging one or more notches 608, 610 formed in a peripheral wall 603 of recess 601. A bias member 606 can be provided for biasing the disc toward the peripheral wall 603 so that the nub remains seated within a respective one of the notches 608, 610. The disc can be manually operated to overcome the force of the bias member so as to disengage the nub 616 from the notches 608, 610. More particularly, the foot 25 can be pulled in the direction shown by arrow 618 to disengage the nub 616 from notch 608 or manually pulled in the direction of arrow 620 to disengage the nub 616 from the notch 610. In either case, the manual force applied to the foot 25 will overcome the force of bias member 606. Once the nub is disengaged from notch 608 or 610, the disc is free to rotate within the recess 603 from a first locked position shown in FIG. 6A to a second locked position shown in FIG. 6C.

According to one embodiment shown in FIGS. 6A–6C, the disc 602 can be formed with an elongated bushing 607. A shaft 604 can extend a short distance from within the recess 601 to extend through the elongated bushing 607. In this way, the disc 602 can be journaled on the shaft 604 for rotational movement as shown. The bias member 606 can be disposed within the elongated bushing for exerting a force against face 609 and shaft 604. For example a coil spring can be used for this purpose. However, the invention is not limited in this regard and any other resilient component can be used to form the bias member.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

What is claimed is:

1. An article of upright rolling luggage, comprising:

a luggage case having a bottom wall, a top wall opposed from said bottom wall, and a rear wall extending between a rear edge of said bottom wall and a rear edge of said top wall;

at least one wheel rotatably mounted to a portion of said luggage case substantially at said rear edge of said bottom wall;

at least one base extending from said bottom wall and having at least one portion spaced apart from said wheel;

at least one foot rotatably mounted to said base, said foot rotatable from a first position where a length of said foot extends in a first direction so that said foot is substantially adjacent to said bottom wall to a second position where said length of said foot extends in a second direction away from a plane defined by said bottom wall;

wherein said at least one foot extends a first distance from said bottom wall when moved to said second position, said at least one wheel extends a second distance from said bottom wall, and said first distance is greater than said second distance.

2. The article of upright rolling luggage according to claim 1 further comprising an extensible luggage handle mounted adjacent to said rear wall of said luggage case.

3. The article of upright rolling luggage according to claim 1 wherein said base is comprised of an elongated body extending between opposing end portions.

4. The article of upright rolling luggage according to claim 3 wherein said at least one foot is pivotally attached to one of said opposing end portions.

5. The article of upright rolling luggage according to claim 4 wherein a second foot is pivotally attached to a second one of said opposing end portions.

6. The article of upright rolling luggage according to claim 3 wherein, said elongated body extends in a direction generally parallel to said rear edge of said bottom wall.

7. The article of upright rolling luggage according to claim 6 wherein said at least one foot is pivotally attached to one of said opposing end portions.

8. The article of upright rolling luggage according to claim 7 wherein a second foot is attached to a second one of said opposing end portions.

9. The article of upright rolling luggage according to claim 1 wherein said foot is lockable in each of said first and second position.

10. The article of upright rolling luggage according to claim 9 wherein said foot comprises a disc, and said disc is rotatably mounted within a recess defined in said base.

11. The article of upright rolling luggage according to claim 10 wherein said recess comprises a first locking structure that is sized and shaped for engaging a second locking structure defined on said disc.

12. The article of upright rolling luggage according to claim 11 wherein said first and second locking structure are selected from the group consisting of a notch and a nub.

13. The article of upright rolling luggage according to claim 11 wherein said disc is resiliently biased for causing said first locking structure to lockingly engage said second locking structure.

14. An article of upright rolling luggage, comprising:

a luggage case having a bottom wall, a top wall opposed from said bottom wall, and a rear wall extending between a rear edge of said bottom wall and a rear edge of said top wall;

at least one wheel rotatably mounted to a portion of said luggage case substantially at said rear edge of said bottom wall;

at least one base extending from said bottom wall at a location spaced apart from said at least one wheel, said base comprised of a ground engaging surface opposed from said bottom wall;

at least one foot rotatably mounted to said base, said foot rotatable from a first position where said foot is between said bottom wall and said ground engaging surface, and extends in a first direction adjacent to a plane defined by said bottom wall, to a second position wherein said foot extends away from said plane defined by said bottom wall and beyond said ground engaging surface;

wherein said at least one foot extends a first distance from said bottom wall when moved to said second position, said at least one wheel extends a second distance from said bottom wall, and said first distance is greater than said second distance.

15. The article of upright rolling luggage according to claim 14 further comprising an extensible luggage handle mounted adjacent to said rear wall of said luggage case.

16. The article of upright rolling luggage according to claim 14 wherein said base is comprised of an elongated body extending between opposing end portions.

17. The article of upright rolling luggage according to claim 16 wherein said at least one foot is attached to one of said opposing end portions.

18. The article of upright rolling luggage according to claim 17 wherein a second foot is pivotally attached to a second one of said opposing end portions.

19. The article of upright rolling luggage according to claim 14 wherein said foot is lockable in each of said first and second position.

20. The article of upright rolling luggage according to claim 19 wherein said foot comprises a disc, and said disc is rotatably mounted within a recess defined in said base.

21. The article of upright rolling luggage according to claim 20 wherein said recess comprises a first locking structure that is sized and shaped for engaging a second locking structure defined on said disc.

22. The article of upright rolling luggage according to claim 21 wherein said first and second locking structure are selected from the group consisting of a notch and a nub.

23. The article of upright rolling luggage according to claim 21 wherein said disc is resiliently biased for causing said first looking structure to lockingly engage said second locking structure.

24. An article of upright rolling luggage, comprising:

a luggage case having a bottom wall, a top wall opposed from said bottom wall, and a rear wall extending between a rear edge of said bottom wall and a rear edge of said top wall;

at least one wheel rotatably mounted to a portion of said luggage case substantially at said rear edge of said bottom wall;

at least one base extending away from said bottom wall and having at least one portion spaced apart from said at least one wheel, said base comprised of an elongated body and having a ground engaging surface opposed from said bottom wall;

at least one foot rotatably mounted to said base, said foot rotatable from a first position generally parallel to a plane defined by said bottom wall where said foot is between said bottom wall and said ground engaging surface, to a second position wherein said foot extends away from said plane defined by said bottom wall and beyond said ground engaging surface;

wherein said at least one foot extends a first distance from said bottom wall when moved to said second position said at least one wheel extends a second distance from said bottom wall, and said first distance is greater than said second distance.

25. An article of upright rolling luggage, comprising:

a luggage case having a bottom wall, a top wall opposed from said bottom wall, and a rear wall extending between a rear edge of said bottom wall and a rear edge of said top wall;

at least one wheel rotatably mounted to a portion of said luggage case substantially at said rear edge of said bottom wall;

at least one base extending from said bottom wall at a location spaced apart from said wheel;

at least one foot pivotally mounted to said base, said foot pivotable from a first position substantially adjacent to said bottom wall to a second position extending away from a plane defined by said bottom wall;

wherein said at least one foot extends a first distance from said bottom wall when moved to said second position, said at least one wheel extends a second distance from said bottom wall, and said first distance is greater than said second distance.

* * * * *

UNITED STATES PATENT AND TRADEMARK OFFICE

CERTIFICATE OF CORRECTION

PATENT NO. : 7,021,436 B2
APPLICATION NO. : 10/744780
DATED : April 4, 2006
INVENTOR(S) : Hoberman et al.

It is certified that error appears in the above-identified patent and that said Letters Patent is hereby corrected as shown below:

Column 10
Claim 23, line 13, delete “looking” and replace with --locking--.

Signed and Sealed this

Ninth Day of October, 2007

JON W. DUDAS
*Director of the United States Patent and Trademark Office*